US008052449B2

(12) United States Patent
Zhu

(10) Patent No.: US 8,052,449 B2
(45) Date of Patent: Nov. 8, 2011

(54) CARD EDGE CONNECTOR WITH FLOATING PAD THEREON

(75) Inventor: Jian-Kuang Zhu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/875,673

(22) Filed: Sep. 3, 2010

(65) Prior Publication Data

US 2011/0059654 A1 Mar. 10, 2011

(30) Foreign Application Priority Data

Sep. 20, 2009 (CN) ..... 200920309645

(51) Int. Cl.
*H01R 13/62* (2006.01)

(52) U.S. Cl. ..... 439/326

(58) Field of Classification Search ..... 439/326, 439/64, 377
See application file for complete search history.

(56) References Cited

U.S. PATENT DOCUMENTS

| | | | | |
|---|---|---|---|---|
| 2005/0136724 | A1* | 6/2005 | Lin | 439/326 |
| 2007/0123087 | A1* | 5/2007 | Zhang et al. | 439/326 |
| 2008/0020622 | A1* | 1/2008 | Wang | 439/326 |
| 2009/0156047 | A1 | 6/2009 | Zhu et al. | |

* cited by examiner

*Primary Examiner* — Phuong Dinh
(74) *Attorney, Agent, or Firm* — Wei Te Chung; Andrew C. Cheng; Ming Chieh Chang

(57) ABSTRACT

A card edge connector includes an insulative housing defining a central slot expanding along a transverse direction with a plurality of contacts disposed therein. A pair of side arms are disposed at opposite ends thereof and extending along a mating direction perpendicular to the transverse direction. A key is disposed in the central slot adjacent to one of the side arms. A pair of floating pads, each is floatably assembly onto a holding section formed adjacent to the corresponding side arm. And a pair of metal plates, each respectively attached to the corresponding side arm and forming a blocking portion projecting toward the floating pad for avoiding the floating pad releasing from the holding section.

16 Claims, 10 Drawing Sheets

CARD EDGE CONNECTOR WITH FLOATING PAD THEREON

BACKGROUND OF THE INVENTION

1. Field of the Invention

The present invention relates to a card edge connector, and more particularly to a card edge connector with retaining pads thereon for securing the card edge connector onto a printed circuit board.

2. Description of the Related Art

U.S. Patent Publication No. 2009/0156047 discloses a card edge connector for mounting onto a printed circuit board. The connector includes an elongated insulating housing. The housing defines a longitudinal card-receiving slot and two rows of contact-receiving passageways along the opposite top and bottom inner surfaces of the slot to receive a plurality of contacts. A key is formed in the slot at predetermined place to prevent from anti-mating of the card. A pair of side arms respectively extend from two opposite ends of the housing and a metal locking portion is disposed on a front end of each side arm for improving the rigidity of the side arm. Further, a retaining pad is fixed on a bottom face of each side arm for securing the card edge connector onto the printed circuit board.

However, as the retaining pad is securely retained in the side arm and is not adjustable in compliance with the side arm, coplanarity between the solder portion of the retaining pad and the printed circuit board is difficult to obtain when the retaining pad is manufactured with low precision, or the side arm is distorted during the soldering process of the contacts. Thus, it is difficult to securely solder the retaining pad on the printed circuit board. Hence, an improved card edge connector is highly desired to overcome the aforementioned problem.

SUMMARY OF THE INVENTION

Accordingly, an object of the present invention is to provide a card edge connector for improving the coplanarity between retaining pads and a printed circuit board.

In order to achieve the object set forth, a card edge connector includes an insulative housing defining a central slot expanding along a transverse direction with a plurality of contacts disposed therein. A pair of side arms are disposed at opposite ends thereof and extending along a mating direction perpendicular to the transverse direction. A key is disposed in the central slot adjacent to one of the side arms. A pair of floating pads, each is floatably assembly onto a holding section formed adjacent to the corresponding side arm. And a pair of metal plates, each respectively attached to the corresponding side arm and forming a blocking portion projecting toward the floating pad for avoiding the floating pad releasing from the holding section.

Other objects, advantages and novel features of the invention will become more apparent from the following detailed description of the present embodiment when taken in conjunction with the accompanying drawings.

DETAILED DESCRIPTION OF THE INVENTION

Figure 1:
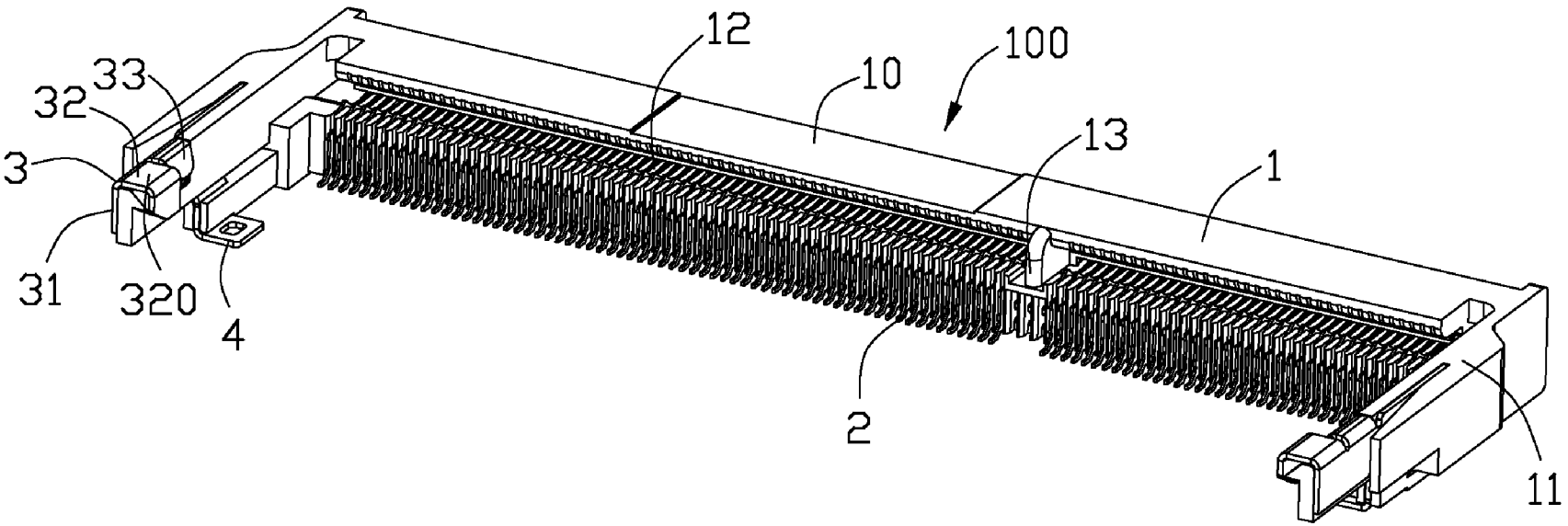
FIG. 1 is a perspective view of a card edge connector in accordance with the present invention.
Figure 2:
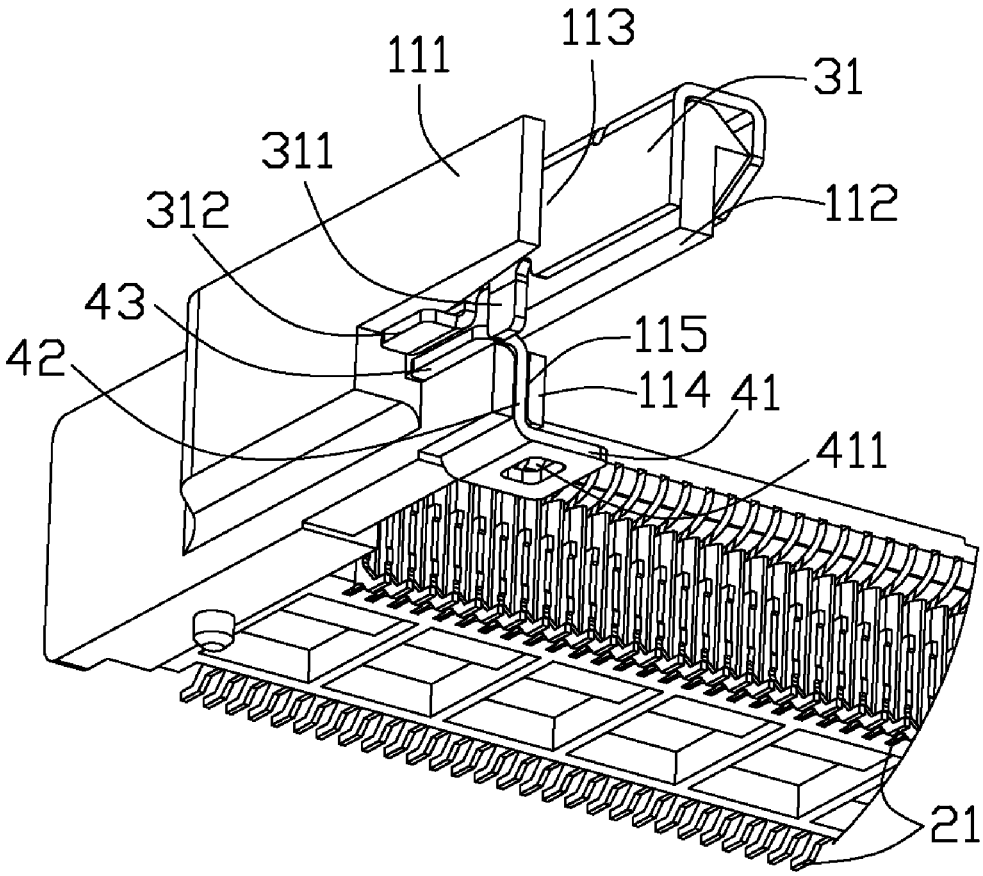
FIG. 2 is a partly amplified perspective view of the card edge connector shown in FIG. 1.

Reference will now be made to the drawing figures to describe a preferred embodiment of the present invention in detail. Referring to FIGS. 1 and 2, a card edge connector 100 made according to the preferred embodiment of the present invention is provided and comprises an insulative housing 1. The insulative housing 1 has an elongated base 10 defining a longitudinal card-receiving slot 12 and two rows of contact-receiving passageways along the opposite top and bottom inner surfaces of the slot 12 to receive a plurality of contacts 2. A key 13 is formed in the slot 12 at a predetermined place to prevent from anti-mating of a card. A pair of side arms 11 respectively extend from two opposite ends of the base 10 and a metal plate 3 is disposed on a front end of each side arm 11 for helping the side arm 11 to guide and retain the card in a horizontal plate when the card is rotatably inserted into the card-receiving slot 12. A pair of retaining pads 4 are respectively assembled on the insulative housing 1 under the corresponding side arms 11.

The card edge connector 100 defines a front-to-rear direction (i.e. a mating direction) and a vertical direction perpendicular to the front-to-rear direction. The side arm 11 comprises an inner arm 112 unitarily extending from the base 10 perpendicularly and an outer arm 111 outwardly extending from the base 10 and positioned beside the inner arm 112 for preventing the inner arm 112 from moving outwardly overly, therefore the inner arm 112 and the outer arm 111 form a fork shape and define a receiving aperture 113 therebetween for holding the metal plate 3 therein. A holding section 114 spaced to the inner arm 112 in the vertical direction extends forward from the base 10 and located under and behind a distal end of each inner arm 112. The holding section 114 defines a through channel 115 therein for floatably receiving the retaining pad 4 therein.

The metal plate 3 comprises an elongated body portion 31 received in the receiving aperture 113, a stopping portion 32 and a guiding portion 33 ordinally extending from a top front edge of the body portion 31 and then inwardly and downwardly bending, a blocking portion 311 straightly extending downwardly from a bottom rear edge of the body portion 31 and an extending portion 312 located behind the blocking portion 311 and bending outwardly from the bottom rear edge of the body portion 31. The stopping portion 32 is located at a front distal end of the inner arm 112 and defines a horizontal stopping face 320. The guiding portion 33 defines a smooth guiding surface for allowing the card to be slidably moving thereon. When the card is inserted into the card-receiving slot 12, if the card is received in the card-receiving slot 12 in an incorrect position at a first step, afterwards, the card is downwardly rotated, side edges of the card around notches defined at opposite sides of the card directly engage and impose the forces upon the stopping portion 32, which will stop the card from further moving on; if the card is received in the card receiving slot 12 in an correct position at a first step, during the downward rotation of the card, the notch will properly pass the stopping portion and reach to a final horizontal position.

Figure 3:
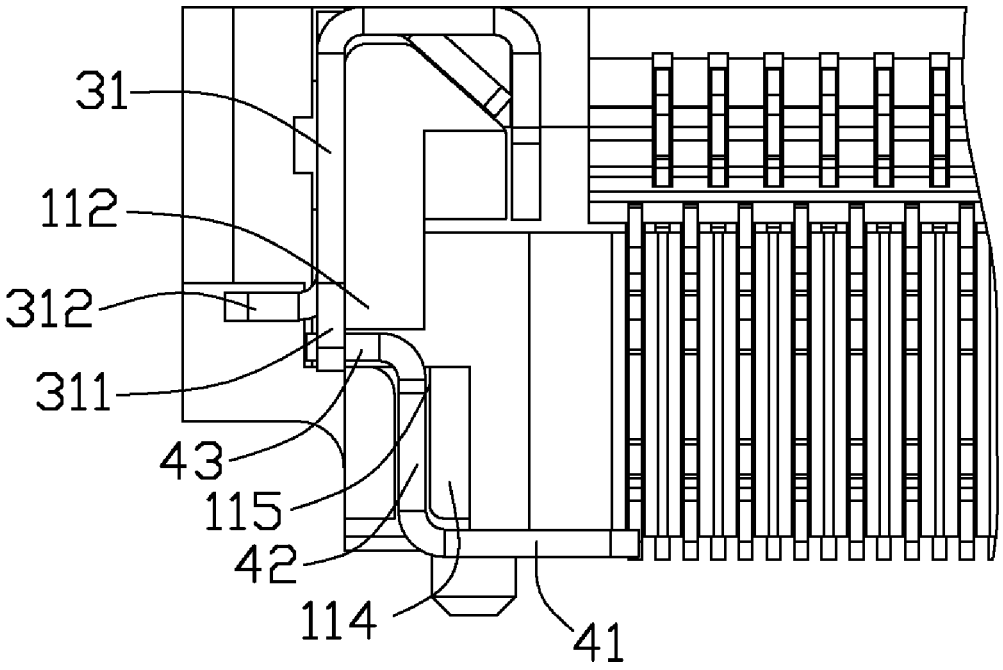
FIG. 3 is a front view of the amplified portion of the card edge connector shown in FIG. 2.

Referring to FIGS. 2 and 3, the retaining pad 4 is made of metal material and configured as a Z shape, which comprises a connecting portion 42 received in the through channel 115 of the holding section 114, and a bending portion 43 and a solder portion 41 respectively bending outwardly from opposite ends of the connecting portion 42 and then respectively extending towards opposite directions perpendicularly. The bending portion 43 is positioned between the inner arm 112 and the holding section 114 to hook with the holding section 114 so as to avoid releasing from the holding section 114. The solder portion 41 defines an opening 411 thereon for concentrating more solder thereon. As the width of the through channel 115 in a transverse direction is bigger than the thickness of the connecting portion 42, the through channel 115 provides a movable space for the retaining pad 4 to adjust its solder portion 41 in compliance to a printed circuit board. Moreover, the length of the connecting portion 42 is bigger than that of the through channel 115 in the vertical direction, which also provides an upward-down movement space for the retaining pad 4.

It is noted that, the blocking portion 311 of the metal plate 3 is positioned in front of the bending portion 43, which can stop the retaining pad 4 from further forward moving. The width of the solder portion 41 and the bending portion 43 can be made differently so as to allow the retaining pad 4 to rotatably adjust its coplanarity due to the gravity impact.

The contacts 2 have solder tails 21 extending out of the insulative housing 1 and arranged in a front row and a rear row. When the card edge connector 100 is mounted onto the printed circuit board, firstly the solder tails 21 are mounted by the surface mount technology and bring a large amount of heat which will result distortion of the side arms 11 and deflection of the retaining pad 4, however, as the retaining pad 4 is floatable in the through channel 115, the solder portion 41 can still be mounted on predetermined place on the printed circuit board.

Figure 4:
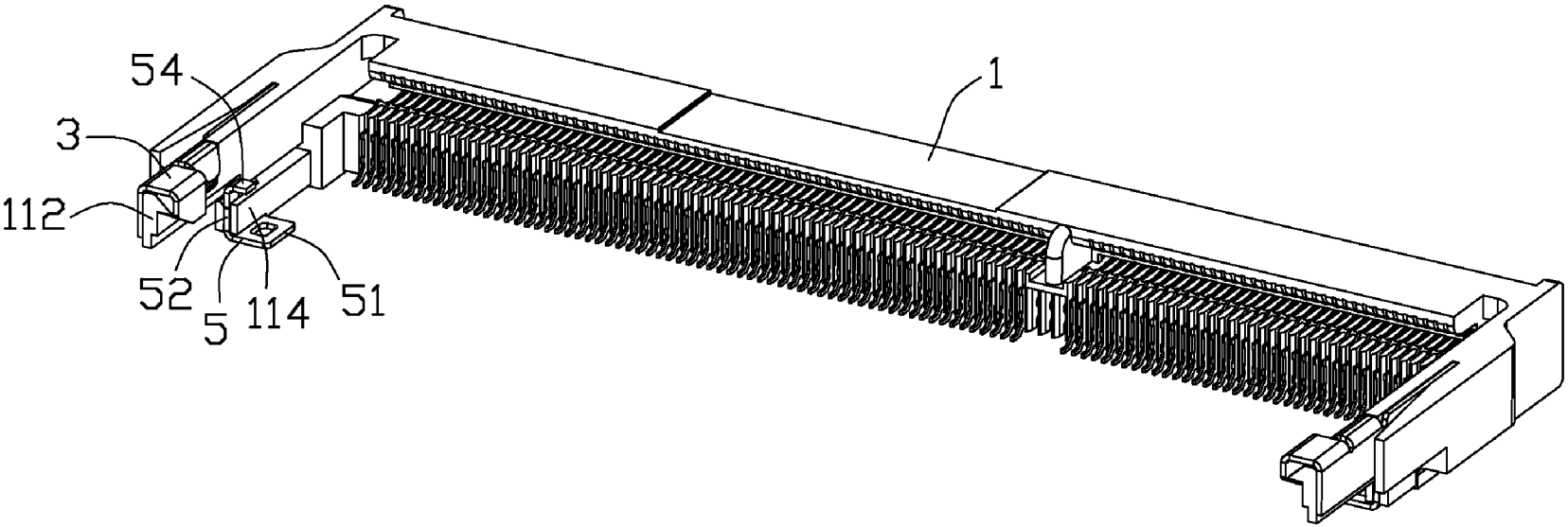
FIG. 4 is a perspective view of a second embodiment of the card edge connector in accordance with the present invention.
Figure 5:
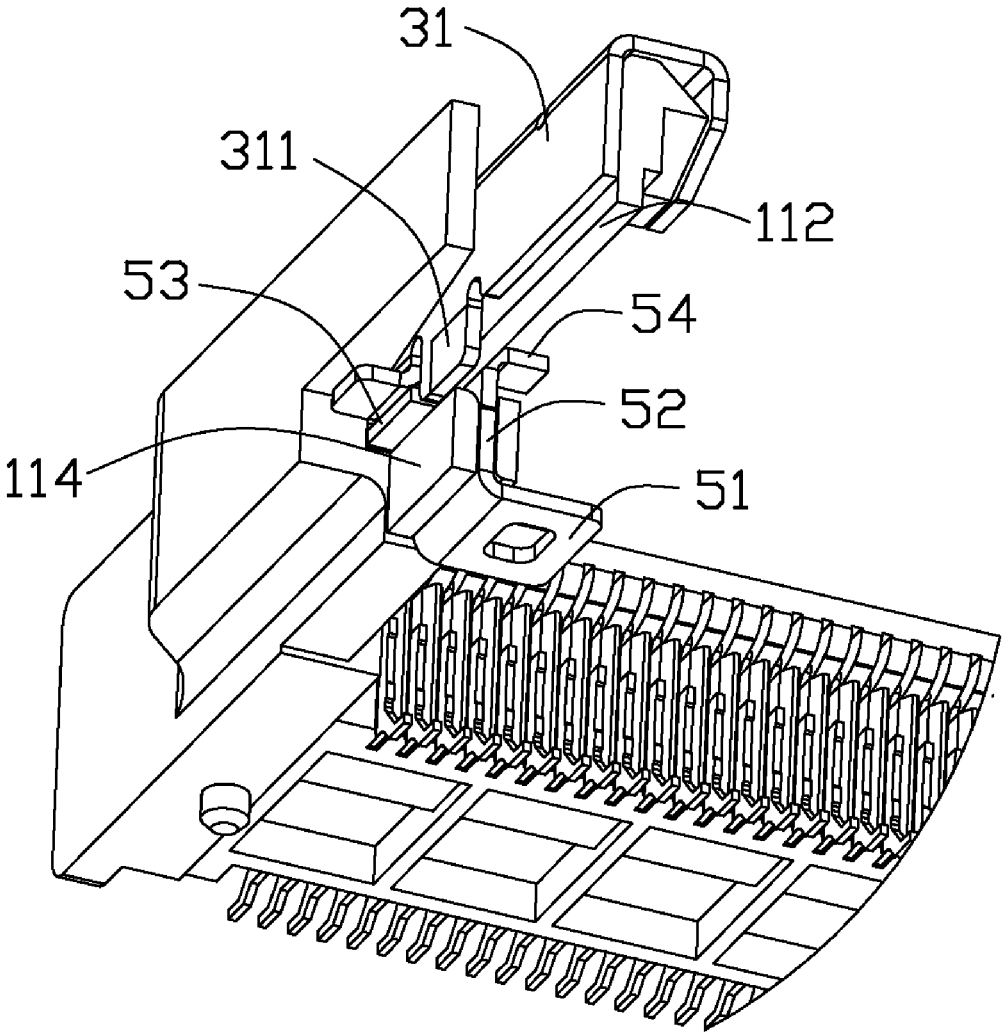
FIG. 5 is a partly amplified perspective view of the card edge connector shown in FIG. 4.
Figure 6:
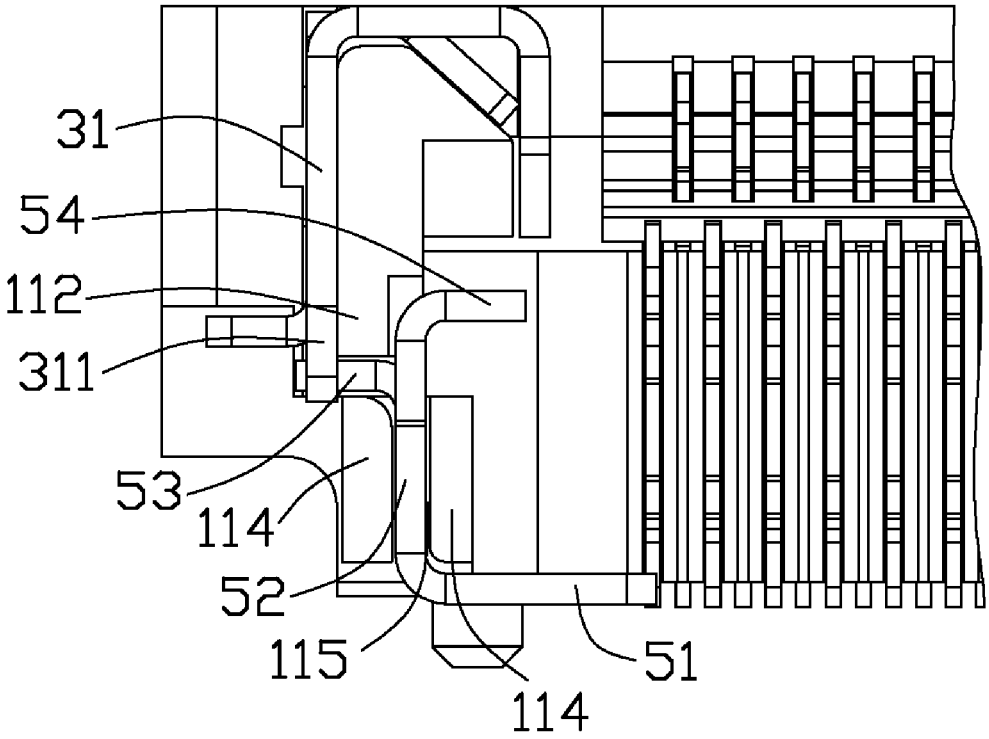
FIG. 6 is a front view of the amplified portion of the card edge connector shown in FIG. 5.

FIG. 4 to FIG. 6 show a second embodiment of the card edge connector in accordance with the present invention. The only difference between the first and second embodiments is the configuration of the retaining pad. The retaining pad 5 also has a connecting portion 52 floatably received in the through channel 115 of the holding section 114, and a bending portion 53 and a solder portion 51 respectively bending outwardly from opposite ends of the connecting portion 52 and then respectively extending towards opposite directions perpendicularly. The connecting portion 52 also forms a supporting portion 54 bending toward a same direction as the solder portion 51 and projecting into a space defined between the two side arms 11. When the card is assembled into the card-receiving slot 12 and rotated to the horizontal position, the supporting portion 54 could support the card in a steady status, which is benefit for improving the performance of the card edge connector. The bending portion 53 is also located behind the blocking portion 311 and can not release from the holding section 114. Further, adjustment of the coplanarity between the solder portion 51 and the printed circuit board can also be achieved.

Figure 7:
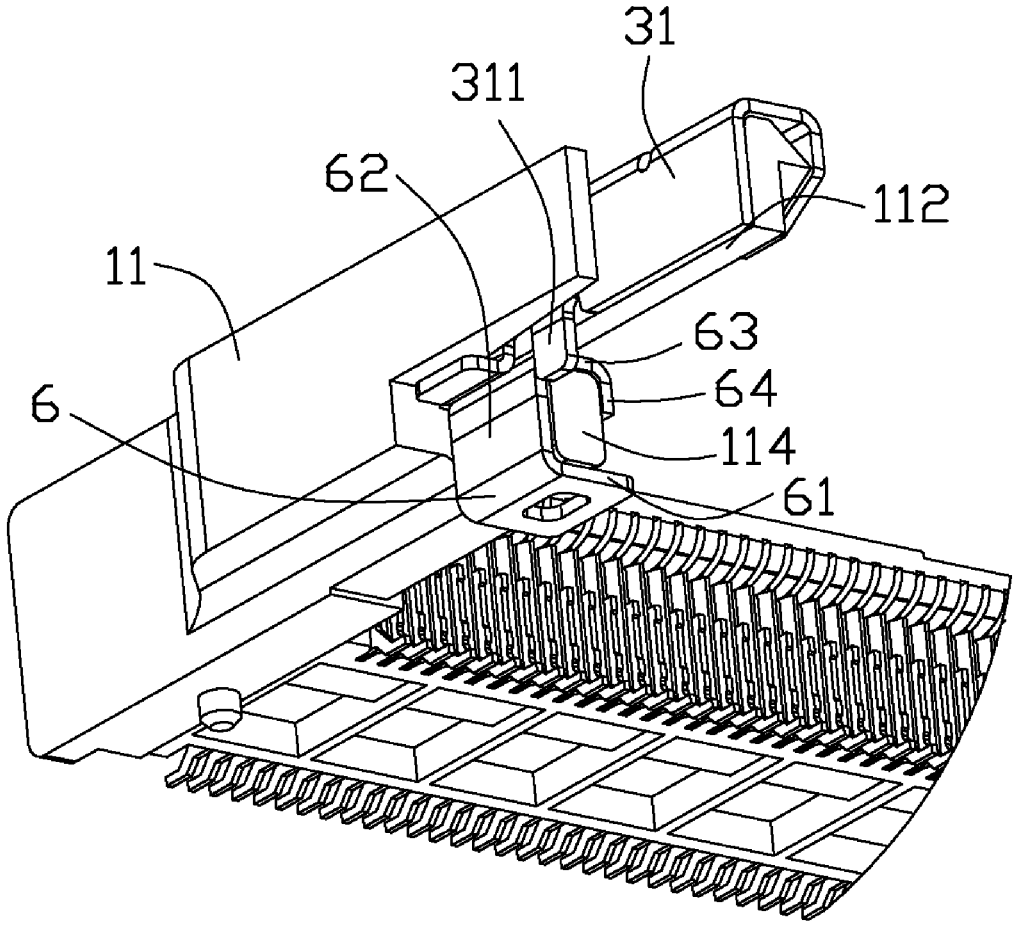
FIG. 7 is a perspective view of a third embodiment of the card edge connector in accordance with the present invention.
Figure 8:
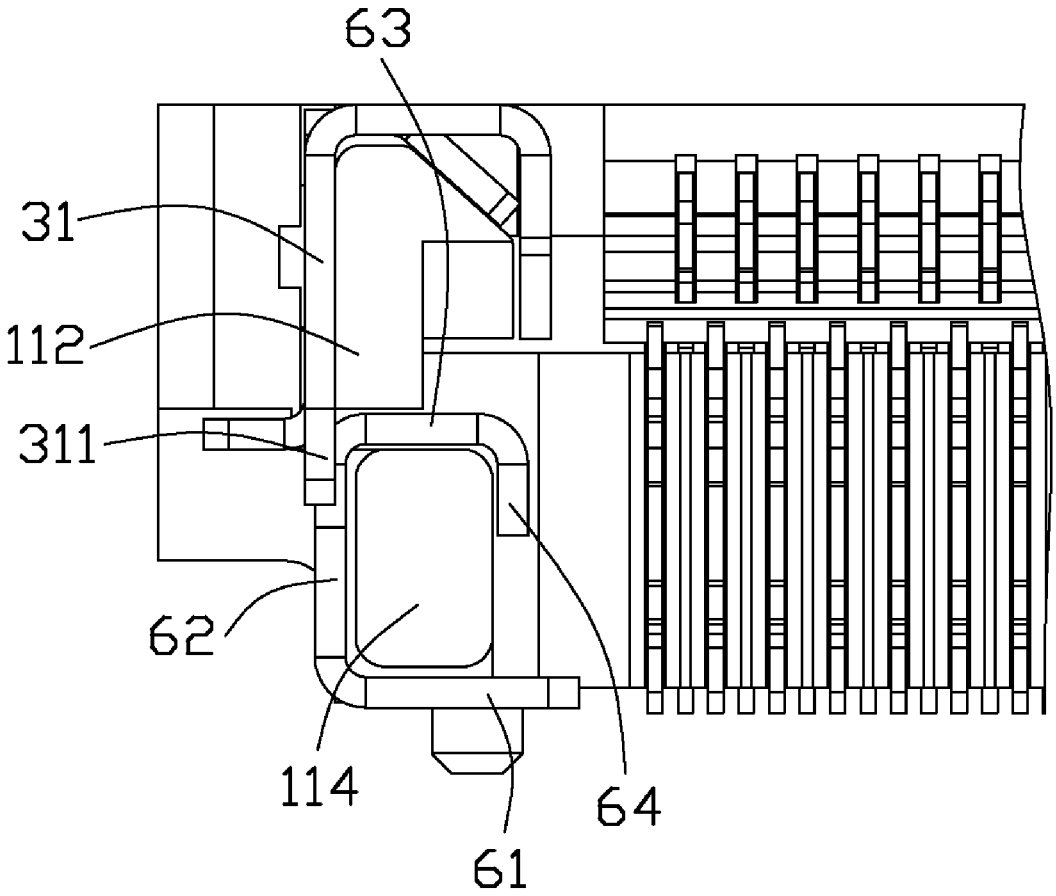
FIG. 8 is a front view of a part of the card edge connector shown in FIG. 7.

FIG. 7 to FIG. 8 show a third embodiment of the card edge connector in accordance with the present invention. The holding section 114 is an integrated part and defines no through channel therein. The retaining pad 6 comprises a connecting portion 62, a solder portion 61 extending inwardly from a bottom edge of the connecting portion 62, a bending portion 63 extending inwardly from a top edge of the connecting portion 62 and facing to the solder portion 61 and a hook portion 64 extending downward from the bending portion 63 and toward the solder portion 61. The retaining pad 6 is configured as a rectangular shape with a gap at a corner seen from a front view. The bending portion 63 is received between the holding section 114 and the inner arm 112, and the connecting portion 62 is located behind the blocking portion 311 and can not release from the holding section 114. The distance between the connecting portion 62 and the hook portion 64 is bigger than the width of the holding section 114 in the transverse direction, and the distance between the solder portion 61 and the bending portion 63 is bigger than the height of the holding section 114 in the vertical direction, therefore the retaining pad 6 can floatably assembly on the holding section 114 and have adjustment space to meet the requirement of coplanarity.

Figure 9:
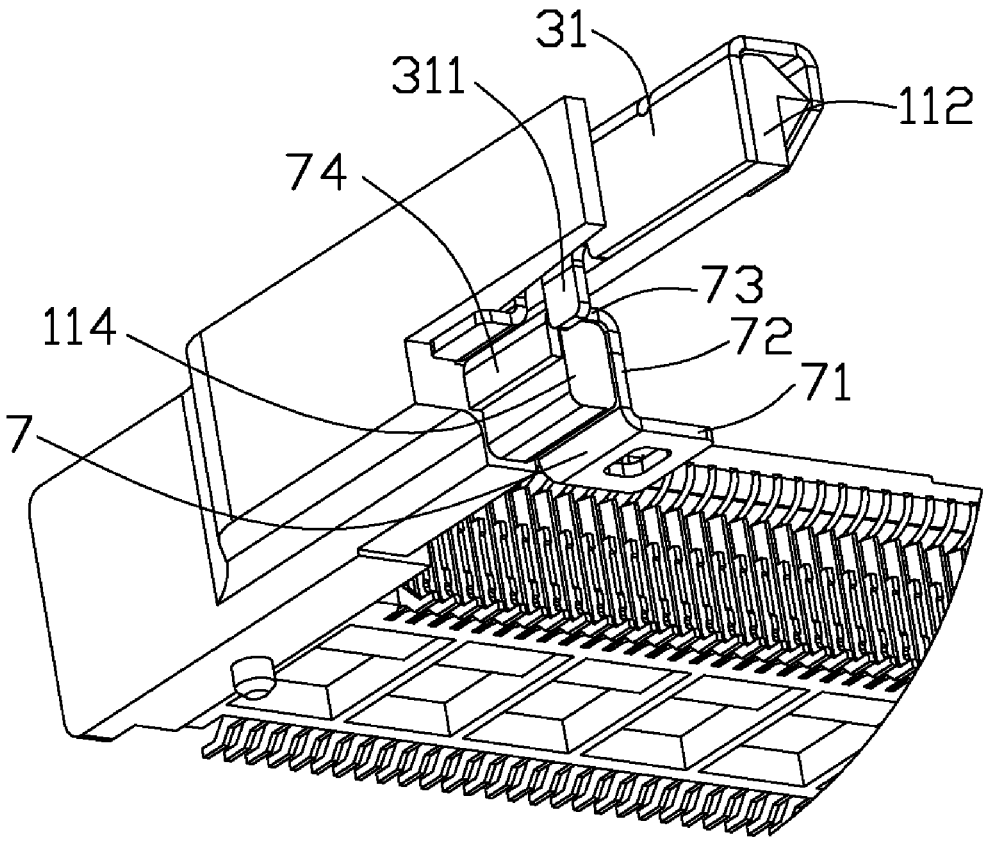
FIG. 9 is a perspective view of a fourth embodiment of the card edge connector in accordance with the present invention.
Figure 10:
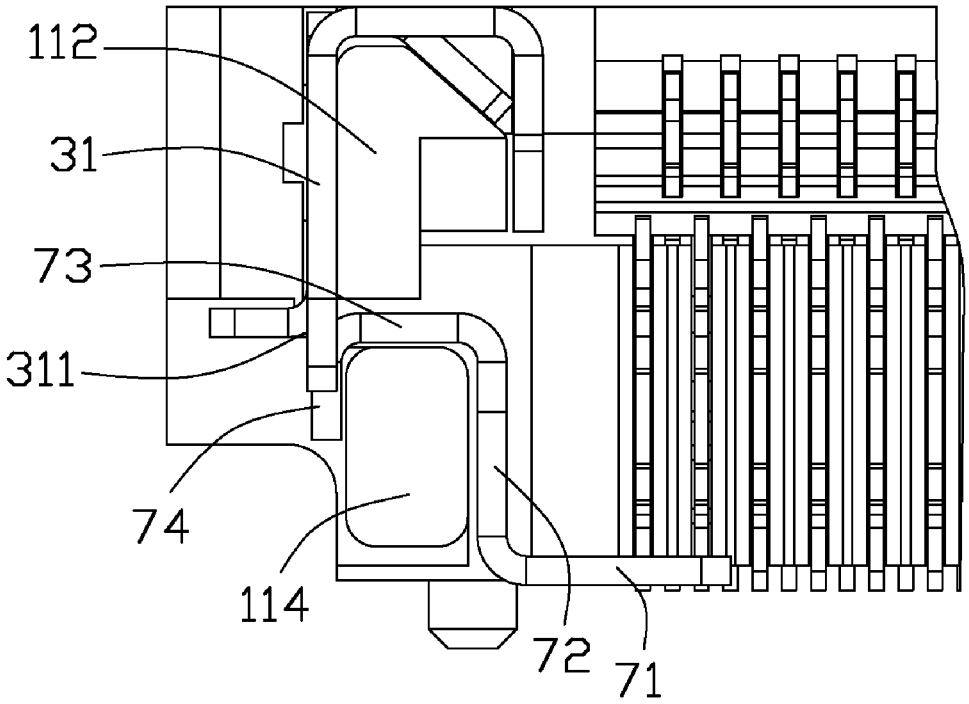
FIG. 10 is a front view of a part of the card edge connector shown in FIG. 9.

FIG. 9 to FIG. 10 show a fourth embodiment of the card edge connector in accordance with the present invention. The difference between the fourth and third embodiments is the configuration of the retaining pad. The retaining pad 7 is configured as a Z shaped and comprises a solder portion 71 located at one side of the holding section 114, a connecting portion 72 extending upward from the solder portion 71 and located at the same side of the holding section 114, a bending portion 73 extending from an upper edge of the connecting portion 72 and protruding toward the other side of the holding section 114, and a hook portion 74 perpendicular extending downward from the bending portion 73 and located at the other side of the holding section 114. The hook portion 74 is located behind the blocking portion 311 and can not release from the holding section 114. The distance between the hook portion 74 and the connecting portion 72 are bigger than the width of the holding section 114 in the transverse direction, therefore retaining pad 7 can floatably assembly on the holding section 114 and have adjustment space to meet the requirement of coplanarity.

The above mentioned four embodiments of the retaining pad 4, 5, 6, 7 could floatably assembly on the holding section 114, therefore they are commonly named as floating pads. It is noted that the floating pads are assembled on the holding section 114 along the mating direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for connecting a card to a printed circuit board comprising:

an insulative housing defining a central slot expanding along a transverse direction with a plurality of contacts disposed therein, a pair of side arms disposed at opposite ends thereof and extending along a mating direction perpendicular to the transverse direction, and a key disposed in the central slot adjacent to one of the side arms;

a pair of floating pads, each floatably assembly onto a holding section which is formed adjacent to the corresponding side arm; and a pair of metal plates, each respectively attached to the corresponding side arm and forming a blocking portion projecting toward the floating pad for avoiding the floating pad releasing from the holding section.

2. The card edge connector as described in claim 1, wherein each holding section is located under the side arm and is spaced to the side arm thereby leaving an aperture therebetween for receiving part of the floating pad therein.

3. The card edge connector as described in claim 2, wherein the blocking portion of each metal plate projects downwardly and is located in front of said part of floating pad.

4. The card edge connector as described in claim 3, wherein each holding section defines a through channel for allowing the floating pad to be assembled thereinto along the mating direction, and an adjustment space is defined between the floating pad and the through channel.

5. The card edge connector as described in claim 4, wherein each floating pad comprises a connecting portion received in the through channel and a bending portion and a solder portion respectively extending from upper and lower edges of the connecting portion and projecting toward opposite directions.

6. The card edge connector as described in claim 3, wherein an outer arm is defined beside each side arm for preventing the side arm from moving outwardly overly.

7. A card edge connector for connecting a card to a printed circuit board comprising:

an insulative housing defining a central slot expanding along a transverse direction with a plurality of contact receiving slots disposed therein, a pair of side arms disposed at opposite ends thereof and extending along a mating direction perpendicular to the transverse direction, and a key disposed in the central slot and extending along a vertical direction perpendicular to said transverse direction and mating direction;

a plurality of contacts received in the contact receiving slots and each forming a solder tail protruding out of the insulative housing;

a pair of floating pads, each floatably assembly onto a lower section of the insulative housing along the mating direction; and a pair of metal plates assembled onto corresponding side arms after the floating pads are assembled and each forming a blocking portion straightly projecting downwardly and located in front of the floating pad for avoiding the floating pad releasing from the lower section.

8. The card edge connector as described in claim 7, wherein an upper section of the floating pad is configured as different shapes or weights comparing with the lower section of the floating pad thereby the floating pad could adjust its coplanarity due to the gravity impact.

9. The card edge connector as described in claim 8, wherein the blocking portion protrudes toward the lower section and located at an outer side of the lower section of the insulative housing.

10. A card edge connector for use with a memory module and printed circuit board, comprising:

an insulative housing for mounting to the printed circuit board and including an elongated body with a central slot therein along a longitudinal direction and a pair of side arms located at two opposite ends of the body, each of said side arms extending forwardly to form a memory module holding area, each of said side arms including a retention portion defining a vertical slot extending through an upper surface, a bottom surface and a front surface of said portion for communicating with an exterior forwardly, upward and downwardly;

a plurality of contacts disposed in the housing with front contacting sections extending into the central slot for electrically and mechanically connecting to the memory module and with rear soldering sections for surface mounting to the printed circuit board;

a pair of floating solder pads assembled to the corresponding side arms, respectively, each of said floating solder pads including a vertical section received in the corresponding vertical slot, a lower laterally extending section intimately confronting the bottom surface, and an upper laterally extending section intimately confronting the upper surface commonly in a floating member at least in a vertical direction perpendicular to said longitudinal direction so as to have the lower laterally extending section comply with the rear soldering sections to commonly mounting to the printed circuit board in a coplanar manner.

11. The electrical connector as claimed 10, wherein said floating solder pads are of either a Z-like shape or a horizontally lying U-like shape in an elevational view.

12. The electrical connector as claimed in claim 10, wherein each of said floating solder pads is assembled into the corresponding vertical slot via said front surface in a front-to-back direction perpendicular to said longitudinal direction and said vertical direction.

13. The electrical connector as claimed in claim 12, wherein each of the side arms is equipped with a blocking member around the upper surface thereof to block forward movement of the corresponding floating solder pad so as to loosely retain the corresponding floating solder pad on the retention portion.

14. The electrical connector as claimed in claim 13, wherein said blocking member is formed on a metallic member which is assembled to the side arm in said front-to-back direction and located beside the memory module holding area for restricting movement of the memory module at least either along the longitudinal direction or further in said vertical direction.

15. The electrical connector as claimed in claim 14, wherein said blocking member is located in front of the upper laterally extending section of the corresponding floating solder pad.

16. The electrical connector as claimed in claim 15, wherein the housing, the floating solder pad and the metallic plate are configured to have the metallic member assembled to the housing only after the floating solder pad is assembled to the retention portion of the corresponding side arm; otherwise, the blocking member on the metallic plate prevents assembling of the upper laterally extending section of the corresponding floating solder pad to the corresponding retention portion.

* * * * *